US006705326B2

(12) United States Patent
Rosler

(10) Patent No.: US 6,705,326 B2
(45) Date of Patent: Mar. 16, 2004

(54) PACKAGING FOR A CIGAR

(76) Inventor: Peter Rosler, Ifenweg 3, D-88239, Wangen (DE)

( * ) Notice: Subject to any disclaimer, the term of this patent is extended or adjusted under 35 U.S.C. 154(b) by 0 days.

(21) Appl. No.: 09/994,117

(22) Filed: Nov. 26, 2001

(65) Prior Publication Data

US 2003/0079754 A1 May 1, 2003

(30) Foreign Application Priority Data

Oct. 31, 2001 (DE) ..... 101 53 240

(51) Int. Cl.[7] ..... B65D 69/00

(52) U.S. Cl. ..... 131/250; 131/248; 131/253; 131/255; D27/195; 206/238

(58) Field of Search ..... 131/250, 248, 131/253, 254, 255, 256, 233, 238, 251; D27/195; 30/111, 112, 113, 109, 113.1, 316; 206/238

(56) References Cited

U.S. PATENT DOCUMENTS

| | | | | | |
|---|---|---|---|---|---|
| 1,674,271 | A | * | 6/1928 | Winquist | 30/279.6 |
| 5,862,809 | A | * | 1/1999 | Nicotra | 131/256 |
| 6,161,550 | A | * | 12/2000 | Kontos | 131/250 |
| 6,290,059 | B1 | | 9/2001 | Chuan | |

FOREIGN PATENT DOCUMENTS

| | | | |
|---|---|---|---|
| DE | 29 07 502 | A1 | 12/1979 |
| DE | 200 06 525 | U1 | 3/2000 |
| DE | 200 06 053 | U1 | 7/2000 |
| GB | 2022547 | A | 2/1979 |

* cited by examiner

*Primary Examiner*—Dionne A. Walls
(74) *Attorney, Agent, or Firm*—Cohen & Grigsby, P.C.

(57) ABSTRACT

A packaging for a cigar comprised of a hull, in whose inner space the cigar is taken up, whereby the hull can be closed off with a sealing cover. According to the invention, a cigar cutter is arranged on the sealing cover, which is joined to the sealing cover, preferably by being fashioned of the same material in one piece.

5 Claims, 3 Drawing Sheets

PACKAGING FOR A CIGAR

Figure 1:
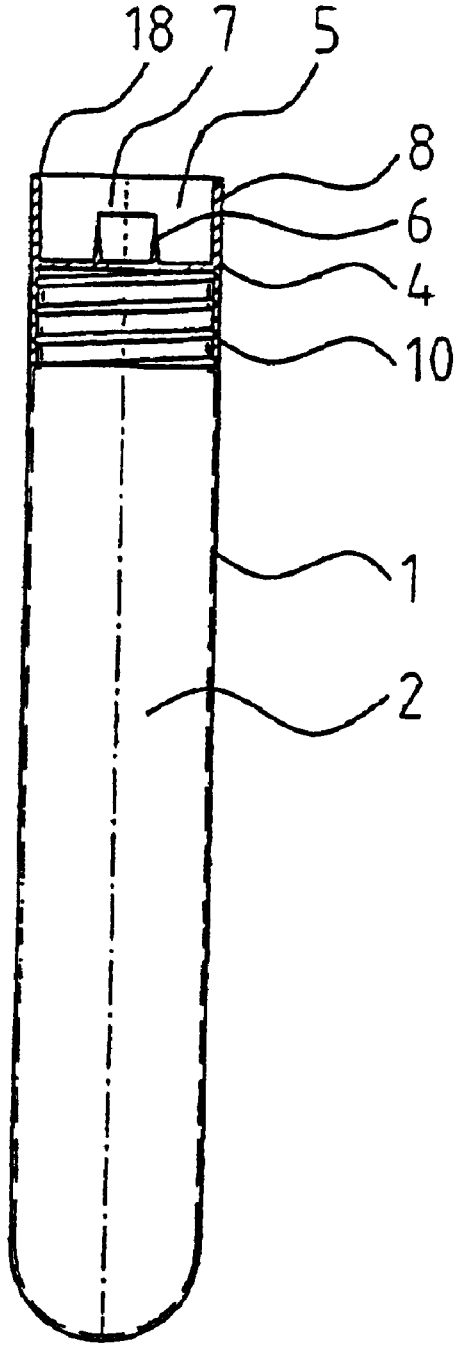

The invention concerns a packaging for a cigar in accordance with the preamble of patent claim 1.

Airtight packaging of a cigar in an individual packaging is known, for which the individual packaging consists of a hull in whose inner space the cigar is taken up and the hull is closed off by a sealing cover. To this end, the hull can be comprised of a plastic material, of metal material, of wood or such similar material.

Furthermore, we are familiar with a hull closed off by a sealing cover, which is designed, for example, as a screw in cover.

In the case of such packaging, the utility purpose is limited however, because after taking the cigar out of the packaging, a so-called cigar cutter is needed with which the tip is cut off in a familiar manner. This cigar cutter must be carried around as a separate utensil.

The object of the invention, is to further develop the packaging design for the initially mentioned type of cigar such that the utility purpose of the packaging is improved and expanded.

To solve the task at hand, the invention is thus characterized, that a cigar cutter is arranged on the sealing cover.

The essential feature consists in that the cigar cutter is secured on the sealing cover such that there is no longer any need to carry around a cigar cutter as a separate utensil.

With this, the utility purpose of the packaging is fundamentally improved, because the cigar cutter that is arranged on or in the sealing cover no longer needs to be carried around separately.

For this, it is preferable, if a somewhat cap shaped sealing cover is fashioned on the open end of the hull, in whose inner space the cigar cutter is arranged. From this results the advantage, that the cigar can be moved from the top toward the hull's open end, whereby the cigar is guided through this hull, and the middle section of the cigar tip is directly guided toward the cigar cutter. On the one hand, this hull serves the purpose of centering the cigar on its way to the cigar cutter, and on the other hand, it serves the safety purpose of preventing the finger from getting directly caught in the path of the cigar cutter.

In a preferred design form, the cigar cutter is comprised of a ring shaped cutting blade which is fashioned on the base of the hull, thus on the covering surface of the sealing cover.

It is preferable, if the cigar cutter, the sealing cover and the hull form one single continuous piece. Such a piece is preferably designed of a plastic injection or plastic molded part.

It is evidently also possible to form the sealing cover with the mentioned elements of aluminum or metal material as well.

The subject of the invention in this current invention results not only from the subject matter of each of the individual patent claims, but rather also from the combination between individual patent claims themselves.

All of the information and characteristics revealed in the documents, including the summary, in particular, the dimensional design represented in the drawings, are claimed as fundamental to the invention, to the extent they are new, either individually or by combination, in terms of the state of the art.

In the following, the invention is described in greater detail by the use of several design models represented in the form of drawings. As a result, additional fundamental characteristics and advantages of the invention emerge from the drawings and their description.

Figure 2:
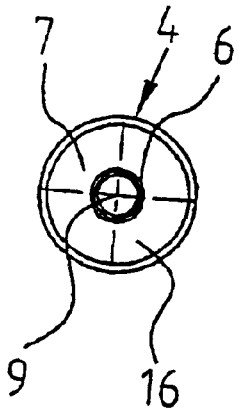
Figure 3:
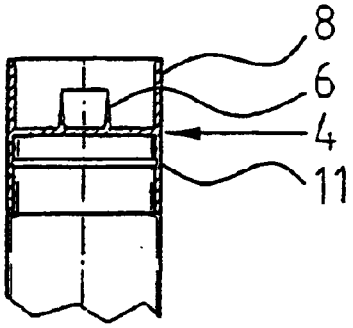
Figure 4:
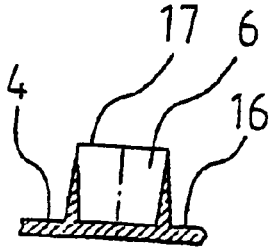
Figure 5:
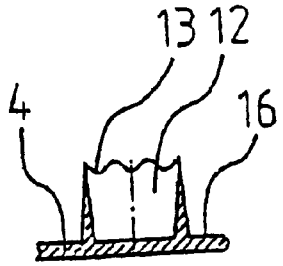
Figure 6:
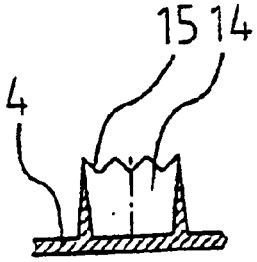
Figure 7:
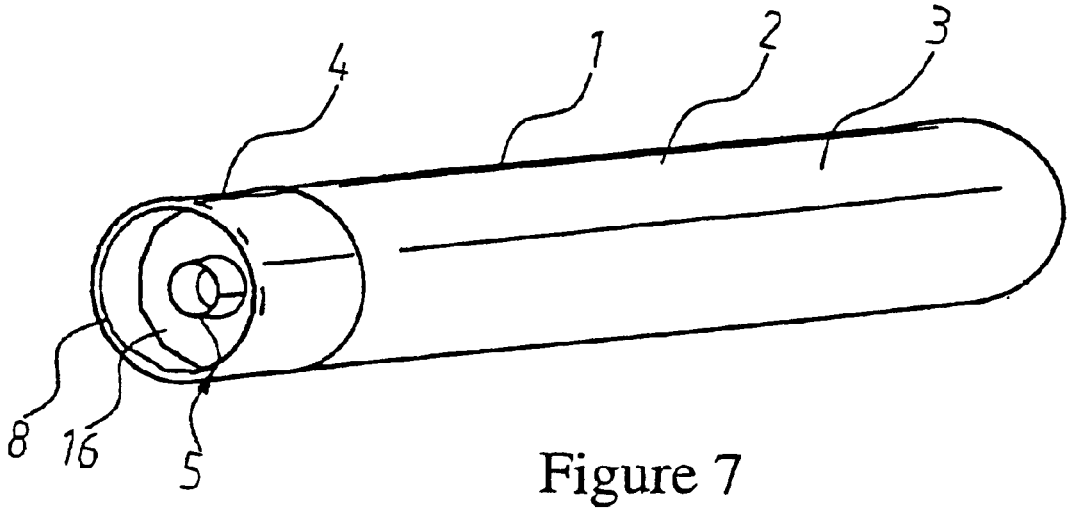

Shown in:

FIG. 1: Section of a packaging for a cigar in a first design form;

FIG. 2: Top view of the representation in FIG. 1;

FIG. 3: Partial section of a second packaging design form;

FIG. 4: Enlarged sectional view through the cutting blade in a first design form;

FIG. 5: Enlarged sectional view through the cutting blade in a second design form;

FIG. 6: Enlarged sectional view through the cutting blade in a third design form;

FIG. 7: Perspective view of a packaging with a cigar contained in it.

In the shown design example, the hull 1, in whose inner space 2 the cigar 3 is taken up, is preferably comprised of a plastic material. By example, the hull is manufactured in a transparent plastic process, in an injection mold or in another molding process. However, the invention is not limited to this.

The hull can also be composed of a metal material (preferably drawn aluminum) or out of wood, paperboard/cardboard or of another material. Foremost in importance is that the hull 1 is closed off by a sealing cover 4 which is joined with a cigar cutter 5.

The cigar cutter 5, according to FIGS. 1 and 2, is comprised of a ring shaped cutting blade 6. An enlarged section through this cutting blade 6 is represented in FIG. 4.

The cutting blade 6 is arranged in the inner space 7 of a surrounding hull 8, and it is fashioned out of one single part and one material there on the covering surface of the sealing cover 4. It is a ring blade, whose cutting edge 17 (see FIG. 4) is designed in a uniform circle.

In one of the other design forms, according to FIG. 5, the cutting edge 13 of the cutting blade 12 exhibits a wave cut, while the cutting blade 14 shown there in FIG. 6 exhibits a cutting edge 15 with a zigzag profile.

In all cases, the cutting blades 6, 12, and 14 are fashioned of one part and one material on the base surface 16 of the sealing cover 4.

However, the invention is not limited to this only. The cutting blades 6, 12, 14 can also be joined to the base surface of the sealing cover 4 as a separate part, for example, by gluing, riveting, friction welding or by other means of securing.

The upward extending inner space 7 in the form of the hull 8, in which the cigar cutter 5 is arranged, serves to center the tip of the cigar which is introduced into the inner space 7 from above. The latter (cigar) is guided, centered, toward the cigar cutter 5, arranged about in the center of the inner space 7.

For this, it can be provided, that the upper circumferential edge of the hull 8 is designed with outward slanting leading edges in order to ensure damage free introduction of the cigars into the inner space 7 of the hull 8.

Upon fashioning the cutting blades 6, 12, 14, designed as ring blades, a central inner space 9 is created and thus defined.

Furthermore, FIG. 1 shows that the sealing cover 4 can be screwed into the hull 1 by means of a screw thread 10.

FIG. 3 shows that in place of a screw thread 10, one or several support ribs 11 can be present arranged spaced apart from one another, such that the sealing cover 4 can be set on the hull to catch and is connected with the latter, yet also detachable.

Furthermore, it is also entirely possible for a person to carry around the sealing cover together with the cigar cutter

5 arranged there, as a separate utensil, whereby a particularly simple design is aimed at, and owing to the pulled up hull 8, the risk of injury due to cutting on the cutting blade 6, 12, 14 is reduced.

Legend to Drawing

1 hull
2 inner space
3 cigar
4 sealing cover
5 cigar cutter
6 cutting blade
7 inner space
8 hull
9 inner space
10 screw thread
11 support rib
12 cutting blade
13 cutting edge
14 cutting blade
15 cutting edge
16 base surface
17 cutting edge
18 leading edge

What is claimed is:

1. Packaging for a cigar, said packaging comprising:

a hull that defines an inner space;

a sealing cover having a base surface that has a sealing side and that has a top side that is oppositely located from said sealing side, the sealing side of said base surface closing off one end of the inner space of said hull at times when the sealing cover is connected to the hull, said sealing cover further including an open ended hull that is connected to the top side of the base surface of said sealing cover, said open ended hull defining an inner space; and a cigar cutter that is secured to the top side of the base surface of said sealing cover and that is located in the inner space that is defined by said open ended hull.

2. The cigar packaging according to claim 1 wherein the cigar cutter is comprised of a ring shaped cutting blade.

3. The cigar packaging according to claim 2 wherein the cutting blade defines a circumferential, straight cutting edge.

4. The cigar packaging according to claim 2 wherein the cutting blade defines a wave shaped cutting edge.

5. The cigar packaging according to claim 2 wherein the cutting blade defines a zig-zag shaped cutting edge.

* * * * *